United States Patent [19]

Pledger et al.

[11] 3,994,244

[45] Nov. 30, 1976

[54] FLUIDIZED WASTE INCINERATOR AND METHOD

[75] Inventors: William Ridley Pledger, Houston; John Edward Gwyn, Pasadena, both of Tex.

[73] Assignee: Shell Oil Company, Houston, Tex.

[22] Filed: Aug. 22, 1975

[21] Appl. No.: 606,814

[52] U.S. Cl. ..... 110/8 F; 110/28 J; 110/119

[51] Int. Cl.[2] ..... F23G 5/00; F23J 15/00

[58] Field of Search ..... 110/8 R, 8 F, 28 J, 110/119; 122/4 D

[56] References Cited

UNITED STATES PATENTS

| | | | |
|---|---|---|---|
| 3,476,062 | 11/1969 | Ramires | 110/8 |
| 3,736,886 | 6/1973 | Menigat | 110/8 |
| 3,921,543 | 11/1975 | Menigat | 110/8 |

*Primary Examiner*—Kenneth W. Sprague

[57] ABSTRACT

Waste material such as sewage biotreater sludge which is partially combustible and contains a substantial proportion of ash, including easily fusible salts, is incinerated in a fluidized bed incinerator provided with a special quench system which protects against premature plugging of the incinerator vapor withdrawal lines. The quench consists of a refractory-lined metal conduit ending approximately flush with the refractory lining of the incinerator in the upper portion of the incinerator dome, a second conduit at approximately right angles for withdrawal of vapors from the first conduit and quench water injection means adapted to inject quench water into the opening of the second conduit. Optionally, the system may be equipped with means for injecting a small proportion of the quench water into the incinerator vapor space just upstream from the vapor offtake conduit and with means for injecting a small proportion of the quench water against the vapor offtake conduit near its intake end, so as to wet the metal surface of the conduit. In the latter case, a lip is mounted on said intake end so as to distribute the water on the full circumference of the conduit and to keep water from the incinerator lining.

5 Claims, 3 Drawing Figures

FIG. 3
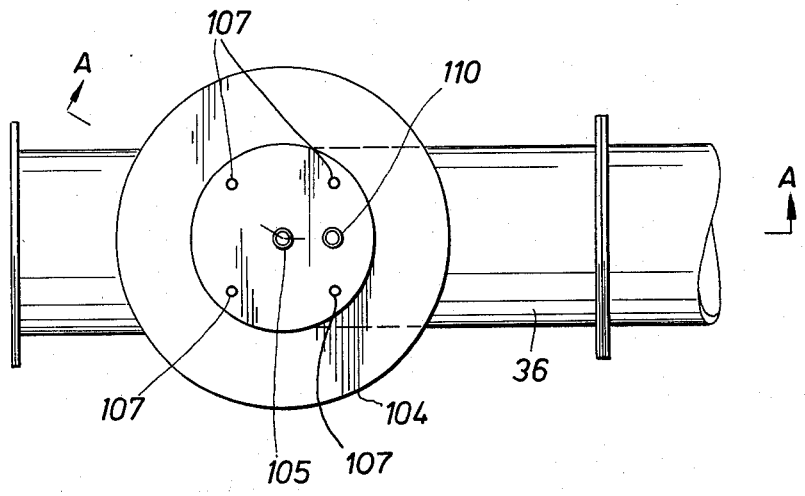
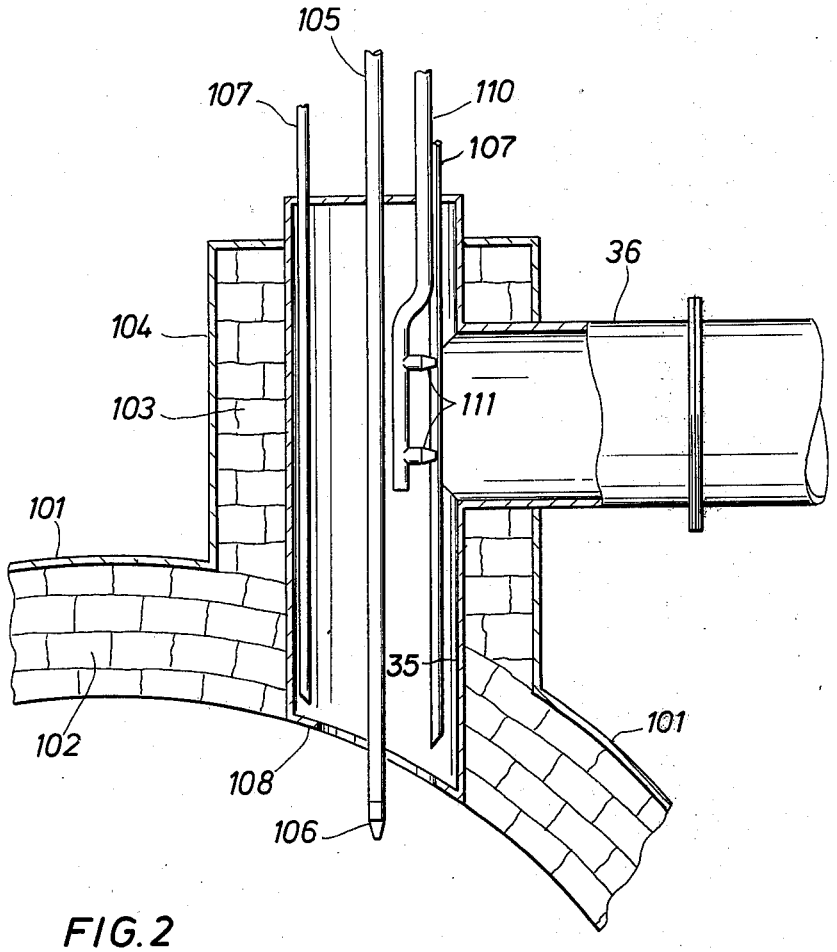
FIG. 2

FLUIDIZED WASTE INCINERATOR AND METHOD

BACKGROUND OF THE INVENTION

1. Field of the Invention

This invention relates to an improvement in burners for waste materials and particularly to an improvement in the quench system of a fluidized bed incinerator for waste materials such as sludge obtained from biotreatment of sewage.

2. Prior Art

Incineration of waste material in fluidized bed incinerators is an established commercial practice.

A patent which discloses a two-stage fluidized bed incinerator and a method for operating it is U.S. Pat. No. 3,306,236 to Campbell. While the present invention may be practiced in a single stage fluidized bed incinerator, the Campbell patent may be referred to for general principles of fluidized bed waste incineration.

A detailed description of a fluidized bed incineration system for petroleum refinery wastes is presented in a publication of the Environmental Protection Agency Water Quality Office. The publication is No. 12,050 EKT 03/71 of the Water Pollution Control Research Series, entitled "Fluid Bed Incineration of Petroleum Refinery Wastes by American Oil Company — Mandan Refinery", available from the Superintendent of Documents, U.S. Government Printing Office, stock number 5501-0052. This publication describes the use a fluidized bed incinerator of the type to which the present invention is particularly applicable. The incinerator described in that publication is one developed by the Copeland Process Corporation of Oakbrook, Ill.

In employing a fluidized bed incinerator for the treatment of the sludge obtained in biotreatment of chemical process wastes, a serious problem was encountered in the case of those wastes in which the sludge contained a large amount of fusible salts. The conventional incinerator provided for injection of sludge feed, quench water, and air into the top of the incinerator vessel. It was found that the injection of quench water into the top of the vessel led to the agglomeration of the sand and ash entering the vapor removal duct and to frequent rapid plugging of the duct, requiring shutdown of the incinerator and laborious clean-up of the vapor removal system.

SUMMARY OF THE INVENTION

The invention consists of an improvement in the quench system for a fluidized bed incinerator which prevents frequent plugging of the incinerator vapor effluent removal system.

Mechanically, the invention consists of a vapor offtake conduit, an optional prequench spray nozzle projecting through the offtake conduit into the incinerator, several optional quench water lines delivering water to a full circle lip on the offtake conduit for distribution, a second conduit, at approximately right angles to the offtake conduit, which communicates with the solids separation and vapor take-off system, main quench water spray nozzles which inject water into the mouth of said second conduit, and water supply lines to said nozzles.

By way of process, the invention consists of a method of quenching the vapor effluent and entrained solids from a fluidized bed incinerator by withdrawing the vapors through an optionally water-wetted conduit and reducing their temperature by water quench immediately upon their exit from that conduit, the quench system being designed to avoid injection of quench water into the incinerator vessel itself except for a small amount which may be injected to precool the effluent stream as it is withdrawn from the incinerator vessel.

BRIEF DESCRIPTION OF THE DRAWING

In the drawing:

FIG. 2 is a detail, shown in elevation, of a vapor withdrawal and quench system according to the present invention, including certain optional features.

FIG. 3 is a plan view of the same detail.

DESCRIPTION OF THE PREFERRED EMBODIMENTS

Figure 1:
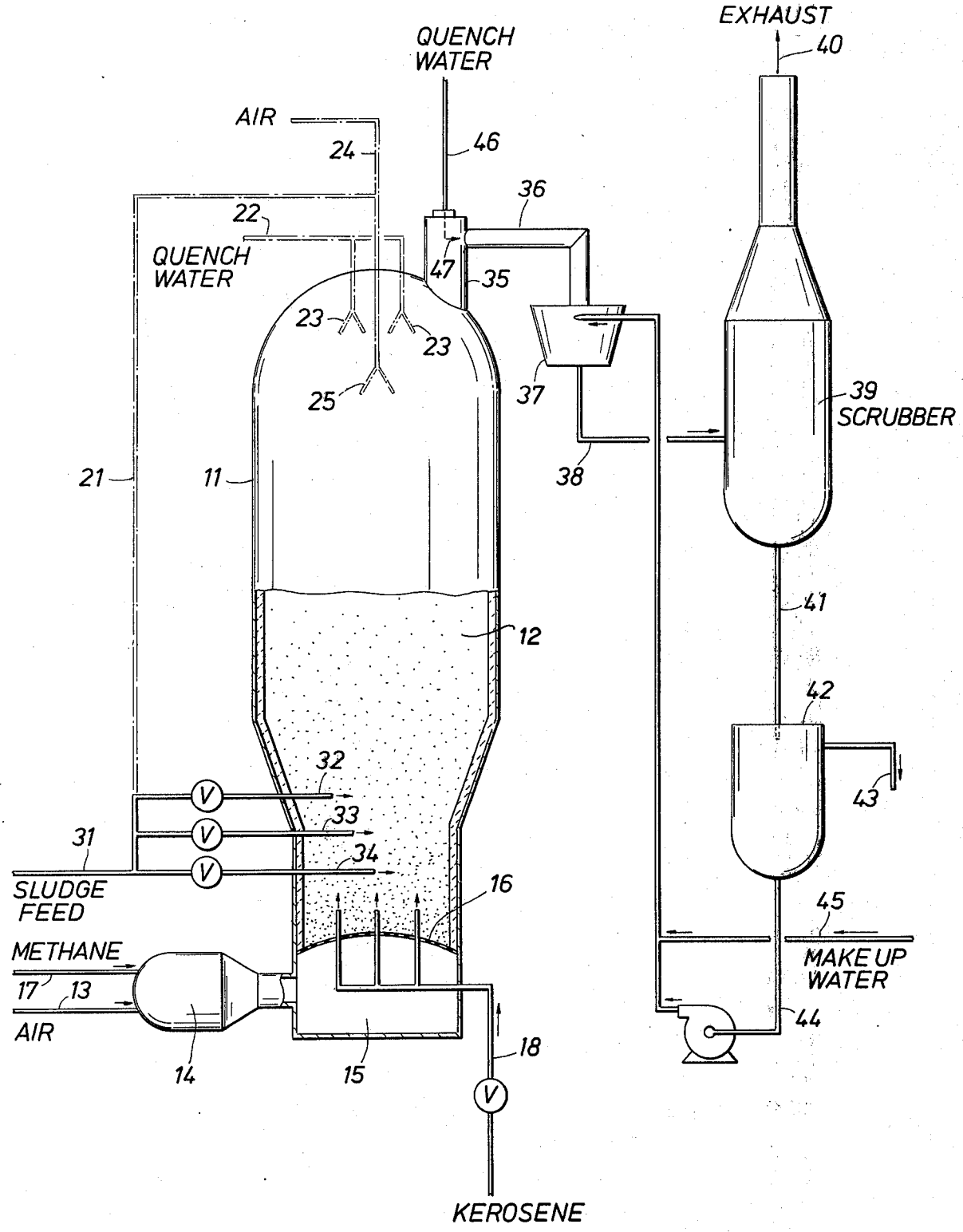
FIG. 1 is a schematic elevation illustrating a fluidized bed incinerator including the vapor withdrawal and scrubbing system associated with it and incorporating the quench system of the present invention.

The present invention is particularly adapted to the fluidized bed incineration of sludge from the biotreatment of chemical or refinery wastes. Such sludge contains typically from 10 to 16 percent of suspended solid matter as a water-wet paste; the solid matter contains a substantial proportion of noncombustible solids, i.e., ash, which is typically from 2 to 3 percent and may be as much as 5 percent. Typically, the inorganic ash generated during incineration may contain 15 percent calcium, 15 percent sodium, 25 percent chloride and 20 percent sulfate. The initial melting point of such ash is about 1100° F. While the bed temperature of the fluidized bed incinerator is held below the melting point of such ash, the upper portions of the incinerator must be allowed to rise above the ash melting point to complete combustion and eliminate odor emission. As a result, in the upper portions of the incinerator, bed particles coated with salts become sticky and tend to agglomerate. It was found that in operation of such an incinerator with the conventional arrangement in which both the sludge feed and the quench water are injected into the top of the incinerator, the solids particles were agglomerated in the upper portion of the incinerator vessel and tended to stick to and quickly plug the vapor drawoff conduit.

It has now been found that the on-stream time of a fluidized bed incinerator of the type described can be extended from about two weeks to several months by modifying the incinerator according to the present invention in which the feed is injected into the fluidized bed and the quench is not injected into the main volume of the incinerator but is arranged so that at most only a small amount of prequench water is injected into the vapor stream just as it enters the vapor offtake conduit, which is arranged at the top of the incinerator vessel and substantially coaxial with the vessel, and the main portion of the quench water is injected into the vapor stream as it exits said first conduit and enters a second conduit which is at right angles to the axis of the first conduit.

The invention will be further illustrated by reference to the drawings.

In FIG. 1 of the drawing, there is shown in elevation a single incinerator vessel 11 with appurtenant equipment. A bed 12 of solid particles is maintained in the lower portion of the vessel. The bed is fluidized by passing gases, perferably air, through it. Air is supplied via line 13 and chambers 14 and 15 and enters the fluidized bed through a grate 16. During startup of the incinerator, methane is also injected through line 17; chamber 14 then serves as a combustion chamber to provide hot gases for heating the fluidized bed to operating temperature. When the bed is in operation, a liquid fuel such as kerosene is normally injected through line 18 directly into the fluidized bed.

The arrangement which was employed prior to the present invention is illustrated by dashed lines in FIG. 1. Sludge feed was injected into the top of the incinerator vessel through line 21 and quench water through line 22 terminating in multiple nozzles 23. Air was injected through line 24, joining the sludge feed and aiding in its atomization through nozzle 25.

In this system, it was found that the heating of the ash above its fusion point caused rapid plugging of the vapor effluent line.

In the incinerator, according to the present invention, sludge feed from line 31 may be injected into the fluidized bed at several levels through lines 32, 33, and 34, as desired. The lines shown as dashed lines in the drawing are removed. Effluent vapor, containing the combustion gases and entrained solids, is withdrawn through the vapor withdrawal system which consists of conduits 35 and 36, Venturi scrubber 37 in which additional water is injected into the vapors, line 38 and scrubber 39 in which remaining solids are removed from the vapor stream. Substantially solids-free vapor is exhausted through line 40 and a slurry of solids in water leaves the scrubber through line 41 to settler 42, from which a relatively clear stream of water is removed through line 43 and a slurry is pumped back through line 44 to vessel 37, together with makeup water from line 45.

The present invention is concerned primarily with the quenching of the vapor effluent stream from the incinerator. As shown schematically in FIG. 1, quench water is injected into the vapor stream leaving conduit 35 and entering conduit 36, through a quench water line 46 equipped with at least one nozzle 47. The quench system is shown in greater detail in FIGS. 2 and 3 in which FIG. 3 is a plan view and FIG. 2 is a section AA through the section lines shown in FIG. 3. This detail shows one preferred mode of practicing the present invention. In FIG. 2, a portion of the dome of the incinerator vessel is represented by 101 and the refractory lining of the vessel by 102. Conduit 35 is a metal conduit adapted to withstand high temperatures. It is surrounded by refractory lining 103 and an outer protective shell 104. It terminates substantially flush with incinerator refractory lining 102. In the illustrated mode of practicing the invention, line 105 is a prequench line which injects a minor proportion of the quench water into the incinerator just below the entrance to conduit 35 in order to precool the vapors to a modest extent so as to reduce the stress on conduit 35. In a now preferred mode of practicing the invention, a liner resistant to higher temperature is employed and prequench line 105 and nozzle 106 are omitted.

A second optional method of protecting the liner consists of a multiple number of quench lines 107 spaced around the circumference of the liner and terminating at the bottom of the liner, to inject a small amount of quench water to be carried up into the liner itself. The water is preferable injected against the wall of the liner. There is also installed a lip in the form of ring 108 to prevent spraying of water onto the incinerator refractory lining.

The major proportion of quench water is injected through line 110 and nozzles 111 into the vapor stream as it exits from conduit 35 and enters conduit 36, as illustrated.

We claim as our invention:

1. In a fluidized bed incinerator for a partially combustible feed such as sewage treatment sludge and the like containing a high proportion of easily fusible salts, which comprises, in combination;

1. a refractory lined vessel;
2. means for maintaining a dense fluidized-solids bed in the lower part of said vessel, including a bed supporting grate and means for forcing air upwardly through said fluidized bed;
3. means for introducing a stream of said feed into said fluidized bed;
4. effluent take-off means communicating with the upper dome of said vessel for withdrawing an effluent stream comprising combustion vapors and entrained solids; and
5. effluent scrubbing means communicating with said effluent take-off means;

the improvement which comprises effluent take-off means comprising 1. a refractory-lined first metal conduit communicating at one end with said vessel and terminating approximately flush with the refractory lining of said vessel and closed at the other end;
2. a second metal conduit communicating with said first metal conduit, arranged at approximately right angles thereto; and
3. quench water injection means arranged inside said first conduit and adapted to direct a spray of quench water directly into the opening of said second conduit.

2. In a fluidized bed incinerator for a partially combustible feed such as sewage treatment sludge and the like containing a high proportion of easily fusible salts, which comprises, in combination 1. a refractory lined vessel;
2. means for maintaining a dense fluidized-solids bed in the lower part of said vessel, including a bed supporting grate and means for forcing air upwardly through said fluidized bed;
3. means for introducing a stream of said feed into said fluidized bed;
4. effluent take-off means communicating with the upper dome of said vessel for withdrawing an effluent stream comprising combustion vapors and entrained solids; and
5. effluent scrubbing means communicating with said effluent take-off means;

the improvement which comprises effluent take-off means comprising 1. a refractory-lined first metal conduit communicating at one end with said vessel and terminating approximately flush with the refractory lining of said vessel and closed at the other end;
2. a second metal conduit communicating with said first metal conduit, arranged at approximately right angles thereto;
3. at least one quench water injection line inside said first conduit, projecting into said vessel beyond the refractory lining and terminating in a quench nozzle; and
4. at least one quench water injection line arranged inside said first conduit and adapted to direct spray of quench water directly into the opening of said second conduit.

3. Apparatus according to claim 2 wherein the intake opening of said first conduit contains a projecting lip which is approximately coplanar with the refractory lining of said vessel and said first conduit further contains multiple quench water injection lines terminating, near said intake opening, in openings adapted to eject water against the surface defined by said lip and the lower end of said first conduit.

4. In the incineration of a partially combustible feed such as sewage treatment sludge and the like containing a high proportion of easily fusible salts which comprises passing said feed into a fluidized bed in an incinerator vessel, withdrawing a vapor stream containing suspended solids from the top of said vessel and quenching the vapor by injecting quench water, the improvement which comprises withdrawing said vapor stream through a first conduit having its entrance flush with the refractory lining of said vessel while injecting a minor portion of the quench water along the side of the first conduit and withdrawing said vapor stream from the first conduit through a second conduit having its entrance flush with the side of the first conduit while injecting the predominant proportion of quench water into the vapor stream as it enters the second conduit.

5. The method according to claim 4 wherein a minor proportion of quench water is injected into said vapor stream as it enters the first conduit.

* * * * *